United States Patent [19]

Dunphy et al.

[11] 4,320,638

[45] Mar. 23, 1982

[54] TUMBLER LOCK AND KEY

[75] Inventors: Gerald F. Dunphy, Glen Waverley; Donald J. Newman, Somerville, both of Australia

[73] Assignee: Ogden Industries Pty. Limited, Huntingdale, Australia

[21] Appl. No.: 148,532

[22] Filed: May 9, 1980

[30] Foreign Application Priority Data

May 10, 1979 [AU] Australia ..... PD8754

[51] Int. Cl.[3] ..... E05B 27/06

[52] U.S. Cl. ..... 70/358; 70/364 A; 70/401; 70/409

[58] Field of Search ..... 70/358, 364 A, 401, 70/405, 406, 407, 409, 419

[56] References Cited

U.S. PATENT DOCUMENTS

| | | | |
|---|---|---|---|
| 1,438,336 | 12/1922 | Schroeder | 70/406 |
| 1,905,177 | 4/1933 | Kirkwood | 70/358 |
| 2,318,887 | 5/1943 | Ramsell | 70/358 |

FOREIGN PATENT DOCUMENTS

| | | | |
|---|---|---|---|
| 258614 | 4/1965 | Australia | 70/406 |

*Primary Examiner*—Robert L. Wolfe
*Attorney, Agent, or Firm*—Berman, Aisenberg & Platt

[57] ABSTRACT

A key blank in which the upper edge surface of the blade has a longitudinal groove dividing that surface into two laterally spaced parts, and a relatively narrow waist is formed in the blade upper portion by progressive narrowing of the blade width downwardly from and adjacent the upper edge surface. The blade is basically a flat parallel sided member and the waisting is created by two substantially symmetrical grooves. Each part of the upper edge surface on each side of the longitudinal groove slopes downwardly and outwardly so as to be substantially normal to the flat sloping surface of the adjacent waisting groove. A key formed from the blank described has bittings cut in the upper edge surface and each bitting is cut on an angle so that the base of each resulting valley part slopes at substantially the same angle as a part of the upper edge surface. Alternate valley base surfaces may slope in opposite directions. A lock having a keyway with a cross sectional shape complimentary to that of the key blank blade described and having two series of pin tumblers arranged angularly relative to one another so that one series is engageable with one upper surface part of the key and the other series is engageable with the other upper surface part of the key. The invention is also directed to a combination of a lock and key described and further to a master keyed system including a plurality of locks and keys.

31 Claims, 16 Drawing Figures

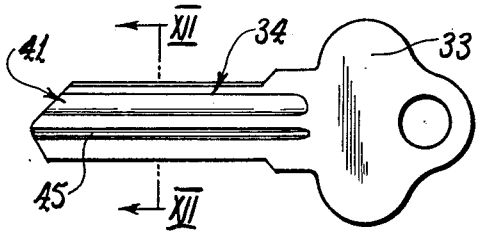
Fig 11
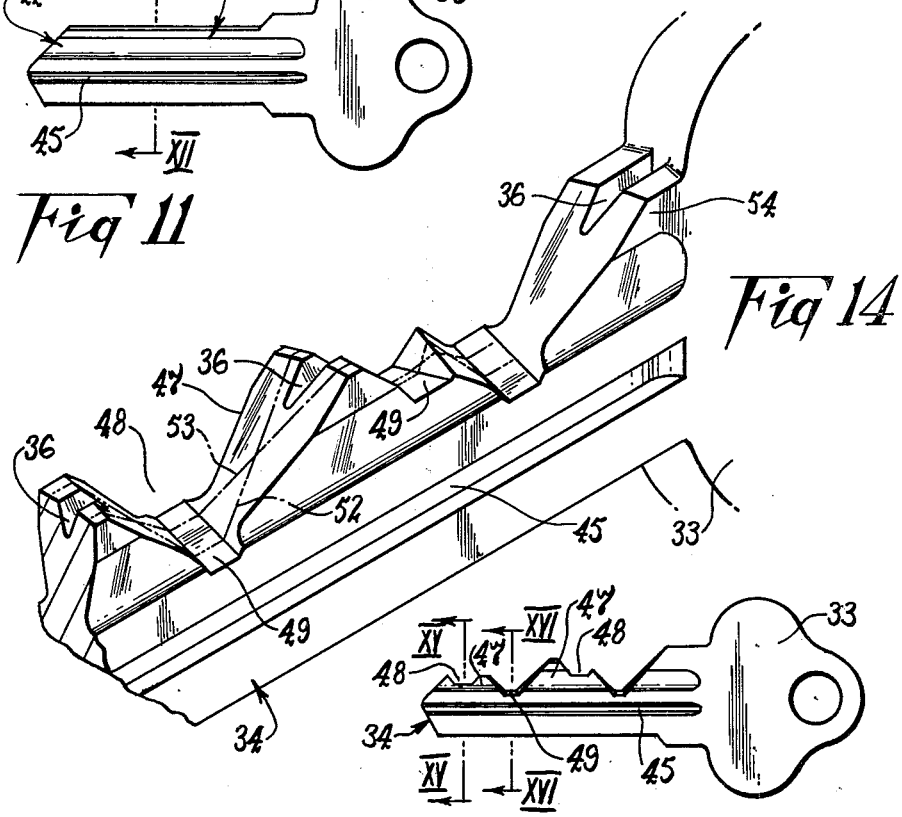
Fig 14
Fig 13
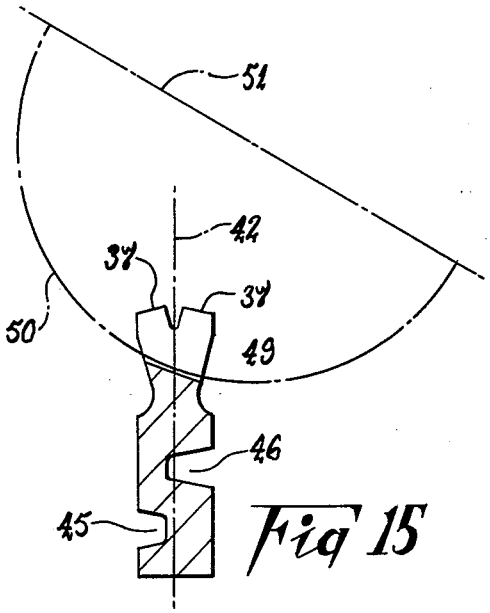
Fig 15
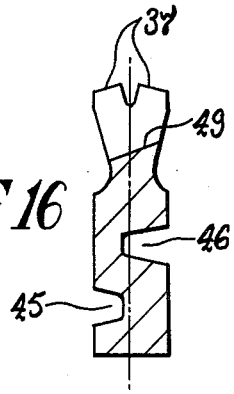
Fig 16

TUMBLER LOCK AND KEY

This invention relates to locks of the kind having pin or other types of tumblers arranged to be lifted by an appropriately cut key to permit a barrel of the lock to be rotated relative to the main body or cylinder of the lock. The invention involves two aspects, one of which concerns the lock itself and the other concerns a key for use with such a lock. It will be convenient to hereinafter describe both aspects with particular reference to pin tumbler locks, but it is to be understood that the invention may be applied to locks having other types of tumblers.

One of the long standing problems connected with tumbler locks is that they are not sufficiently secure against improper manipulation such as through picking. That is, the great majority of such locks can be released without the use of an appropriately cut key and any lock which is substantially resistant to picking is generally of very complex and expensive construction. The security of such locks is further disturbed by the fact that duplication of the keys is usually a very simple operation and machinery is readily available for that purpose. Also, duplication is often possible by simply manufacturing from an impression of the key rather than from the key itself. As a result, high security can only be maintained if access to the key is limited and policed in such a way as to minimize the possibility of copying.

It is an object of the present invention according to one of its aspects, to provide a tumbler lock which is extremely difficult to pick by presently known techniques. It is a further object of the invention to provide such a lock which will receive a specially formed key but will not receive key blades of conventional keys. Yet another object of the invention according to another of its aspects, is to provide a key which is difficult to duplicate without sophisticated machinery and without access to the actual key. Yet another object of the invention is to provide a blank for a key of the aforementioned kind.

In accordance with one aspect of the invention, there is provided a key blank including; an elongate balde having two oppositely facing side surfaces, an upper edge surface and a lower edge surface each of which extends between said side surfaces; a dividing groove separating two laterally spaced parts of said upper edge surface and extending longitudinally inwards of said blade from an outer terminal end thereof; and a waisting groove formed in at least one of said side surfaces at a location adjacent said upper edge surface and extending longitudinally inwards of said blade from said outer terminal end.

According to another aspect of the invention, there is provided a key including; an elongate blade having two oppositely facing side surfaces, an upper edge surface and a lower edge surface, each of which extends between said side surfaces: a series of bittings formed in said upper edge surface to provide a plurality of valleys and humps which alternate in the longitudinal direction of said blade; a dividing groove extending in the longitudinal direction of said blade through the apex region of at least one of said humps and separating two laterally spaced tumbler engaging surface parts of that hump; and a waisting groove formed in at least one of said side surfaces at a location adjacent said upper edge surface and extending longitudinally inwards of said blade from an outer terminal end thereof.

In a preferred form of the key, at least one paracentric groove is formed in each of the side surfaces of the key blade at a location between the waisting groove and the lower edge surface. Each paracentric groove extends longitudinally inwards of the blade from the outer terminal end thereof.

According to yet another aspect of the invention, there is provided a master keyed system including a plurality of keys as described above, at least two of which are operable to open the same lock and each having the same paracentric shape as determined by the location, shape and depth of said paracentric grooves, at least one said key being profiled in the region of said paracentric shape, and said profiling comprising at least one modification to the cross sectional shape of said blade at a place where the surface of the blade changes direction.

According to still another aspect of the invention, there is provided a pin tumbler lock including; a cylinder, a barrel rotatably mounted in said cylinder, a keyway formed through a front end of said barrel and extending inwardly of the barrel in the longitudinal direction of the barrel rotational axis, two series of pin tumblers mounted in said cylinder, each said series including a plurality of pin tumbler groups arranged in spaced relationship in the direction of said rotational axis, the pins of each said group being movable towards and away from said barrel and a lower pin of each said group being adapted to intrude into said keyway, the pins of each said group being movable in a direction angularly disposed relative to the direction of movement of the other said series, said keyway having an upper edge surface located adjacent said tumbler pins, a projection dividing said upper edge surface at least along part of its length, and a relatively narrow neck formed in said keyway at a location closer to said upper edge surface than to a lower edge surface of said keyway.

In a preferred form of the lock, the keyway has at least one paracentric rib projecting inwards from each side surface and extending in the longitudinal direction of the keyway. Each paracentric rib is located below the neck ribs and the keyway has a paracentric shape determined by the locating, shape and depth of the paracentric ribs. It is further preferred that the keyway is profiled in the region of the paracentric shape and that may comprise at least one modification to the cross sectional shape of the keyway at a place where a side surface of the keyway changes direction.

According to a further aspect of the invention, there is provided a lock system including a plurality of locks as described above and at least one key. In that system the keyway of each lock has the same paracentric shape but is profiled differently to the other locks and the key has a blade with a transverse cross sectional shape which is receivable within each of the keyways.

According to a further aspect of the invention, there is provided a combination including a lock as described above and a key having an elongate blade receivable in said lock keyway, said blade having a series of bittings formed in an upper edge surface thereof to provide a plurality of valleys and humps which alternate in the longitudinal direction of said blade, the apex region of at least one said hump being divided by a longitudinally extending groove to permit passage of said blade past said keyway projection, and a separate pin engaging surface part is formed on each side of said groove and each said surface part is engagable with at least one said lower pin of a respective said tumbler pin series.

In another aspect of the invention, there is provided a method of forming a key including the steps of, forming a key blank having a head an elongate blade extending from one side of said head, said blade being substantially flat and parallel sided, forming a dividing groove in one edge surface of said blade to separate two laterally spaced edge surface parts, forming a longitudinal extending waisting groove in each of two side surfaces of said blade adjacent to said divided edge surface, said two waisting grooves being substantially symmetrical about a median plane (as herein defined) of said blade, forming at least one longitudinal extending paracentric groove in each said side surface at a location between the adjacent said waisting groove and an edge surface of said blade remote from said divided edge surface, forming a series of bittings in said divided edge surface to create alternating humps and valleys, each said valley being formed by passing a cutting tool transversely across said divided edge surface and in a direction extending at an angle other than 90° relative to said median plane, the said relative angularity being the same for each alternate valley and being opposite for each two adjacent valleys.

The terms "upper" and "lower" as used throughout the specification to describe the key, key blade and keyway, are not to be understood as limiting the disposition of those components. Such relative terms are used for convenience of description only and in actual use the upper edge surface for example may be located to the side or underneath. In the preferred construction hereinafter described, the upper edge surface of the keyway is that edge through which the pin tumblers intrude into the keyway. The corresponding edge surface of the key is that edge containing the bittings.

The "median plane" of the key blade is the plane which bisects the upper and lower edge surfaces of the blade and is parallel to the longitudinal axis of the blade. In the preferred construction that plane is also parallel to the side surfaces of the blade which are flat and parallel to one another. Similarly, the "median plane" of the keyway bisects the upper and lower edge surfaces of the keyway and is parallel to the longitudinal axis of the keyway.

Reference is also made in the specification to "paracentric shape" which is the shape applied to the lower section of the lock keyway to inhibit picking of the lock. That shape commonly comprises two ribs located out of alignment on respective opposite sides of the keyway and at least one of which extends beyond the centre or median plane of the keyway. A complimentary shape is applied to the lower section of the corresponding key. The paracentric shape also serves to retain the key against undesirable up and down movement relative to the keyway.

The essential feature of the invention, and further optional features, are described in detail in the following passages of the specification which refer to the accompanying drawings. The drawings however, are merely illustrative of how the invention might be put into effect, so that the specific form and arrangement of the features (whether they be essential or optional features) show is not to be understood as limiting on the invention.

In the drawings:

FIG. 11 is a side elevational view of a key blank according to one embodiment of the invention;

FIG. 13 is a side elevation of one embodiment of the invention as applied to a key.

FIG. 14 is a perspective view of portion of the key shown in FIG. 13.

FIGS. 15 and 16 are transverse cross-sectional views taken along Line XV—XV and XVI—XVI respectively of FIG. 13.

Figure 1:
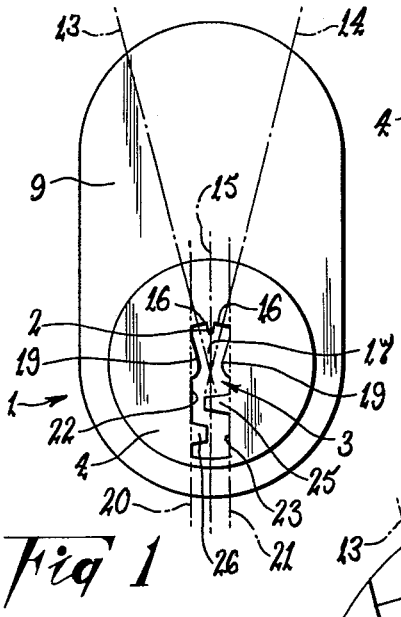
FIG. 1 is an end view of one form of pin tumbler cylinder lock to which an embodiment of the invention has been applied.
Figure 2:
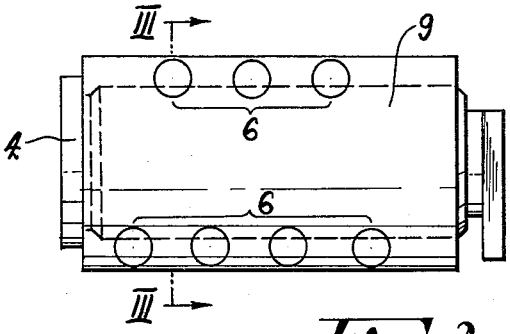
FIG. 2 is a top plan view of the lock shown in FIG. 1.
Figure 3:
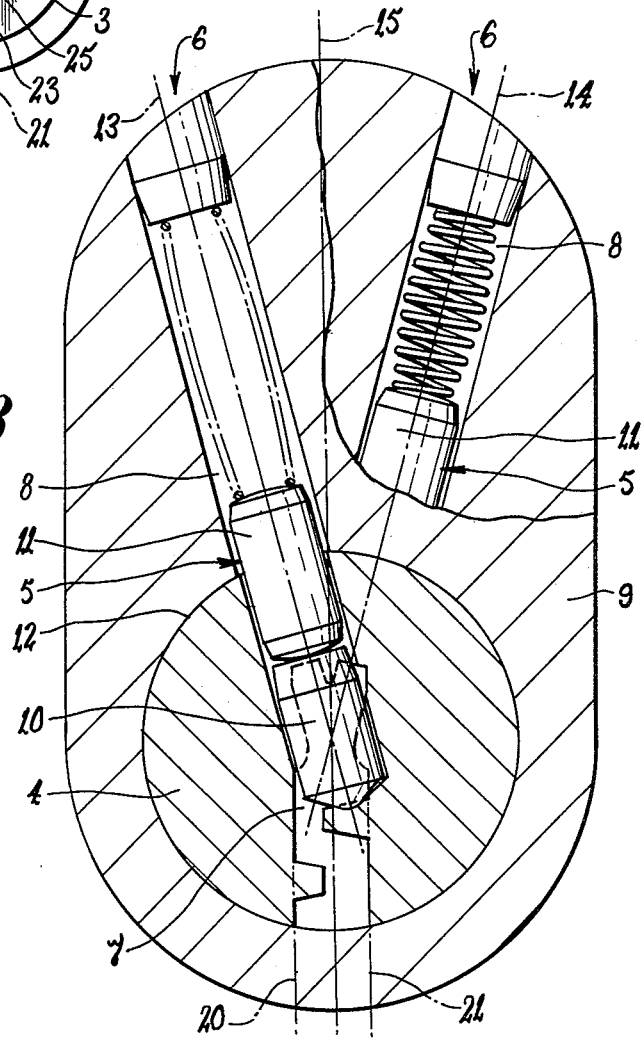
FIG. 3 is an enlarged transverse cross sectional view taken along Line III—III of FIG. 2.

A lock 1 as shown in FIGS. 1 to 3 of the drawings is characterized in that a projection 2 intrudes into the passage provided by the keyway 3 from the top, or upper edge surface of the keyway 3. In the preferred form shown, the projection 2 is provided by a rib located substantially mid-way in the width of the keyway 3 and which is substantially of V-shape in transverse cross section. The top of the keyway 3 is to be understood as that edge through which the tumblers project for engagement with a key inserted into the keyway 3. As hereinafter explained in more detail, the projection 2 serves to inhibit improper release of the lock barrel 4 by picking.

In the preferred arrangement, shown in FIGS. 2 and 3, there are two series 5 of pin tumblers and each includes a plurality of pin groups 6. Nevertheless, the invention could be adopted in a construction in which either or both of the series 5 includes only one pin group 6. A pin group 6 is to be understood as the pins which are contained in the pin bores 7 and 8 of the barrel 4 and cylinder 9 respectively which are aligned in the locked condition of the lock 1 (FIG. 3). In the simple example of FIG. 3, such a group 6 includes a barrel or lower pin 10 and a cylinder pin 11, one of which crosses the parting line 12 between the barrel 4 and cylinder 9 in the locked condition.

The pin groups 6 of a particular series 5 may lie in a common plane as shown—i.e., the axes of all pins 10 and 11 lie in the same plane 13 or 14 (see FIG. 1) when the barrel 4 is in the locked condition. Each plane 13 and 14 may pass through the axis of the barrel 4 as shown and is angularly disposed relative to the median plane 15 of the keyway 3. It is further preferred that the planes 13 and 14 are angularly disposed relative to one another as shown and that angle can be determined to suit particular requirements. In the preferred arrangement shown, the median plane 15 of the keyway 3 bisects the angle subtended between the planes 13 and 14 of the two pin tumbler series 5.

Each pin series 5 may include the same number of groups 6 but that is not essential. Also, the spacing between adjacent groups 6 of the one series 5 need not be regular, but it is preferred that groups of different series 5 are not transversely aligned as such alignment may result in the pins of the two groups 6 fouling with one another. It is possible however, to have the pin groups 6 of the two series 5 arranged in substantially longitudinal alignment—i.e., aligned in a direction generally longitudinal of the barrel 4.

The keyway 3 has an upper edge surface divided by the projection 2 and each separated part 16 of that surface is preferably arranged substantially at right angles to a respective one of the pin series planes 13 and 14, as shown. It is further preferred, as shown, that the width of the keyway 3 progressively narrows downwards in an upper region of the keyway 3 and that creates a narrow neck 17 (FIG. 1) or region of minimum width. In the construction shown, the neck 17 is formed by ribs 18 on respective opposite sides of the keyway 3 and which are substantially symmetrical about the median plane 15. Each rib 18 preferably has a substantially flat face 19 which slopes downwardly and inwardly from adjacent the edge surface part 16 and each of the faces 19 may be substantially parallel to a respective one of the pin series planes 13 and 14. The keyway 3 widens immediately below the narrow neck 17 to a region of maximum width. In the construction shown, the keyway 3 has a maximum width defined between two flat parallel planes 20 and 21, which are also parallel to the median plane 15, and part of each side surface 22 and 23 of the keyway 3 lies in a respective one of the planes 20 and 21.

As a result of the foregoing construction, the pins 10 of each series 5 enter the keyway 3 on respective opposite sides of the keyway projection 2 and the intrusion provided by that projection 2 makes it difficult to lift all pins 10 of both series 5 by means of conventional picking tools such as to release the barrel 4 for rotation. The downwards narrowing of the keyway 3 below the projection 2 adds to the difficulty of picking the lock 1. The narrow neck 17 of the keyway 3 has the further advantage of providing an area 24 (shaded in FIG. 4) able to support pins 10 which penetrate deep into the keyway 3 when a key is not present. The projection 2 serves a similar support function for short pins.

Figure 4:
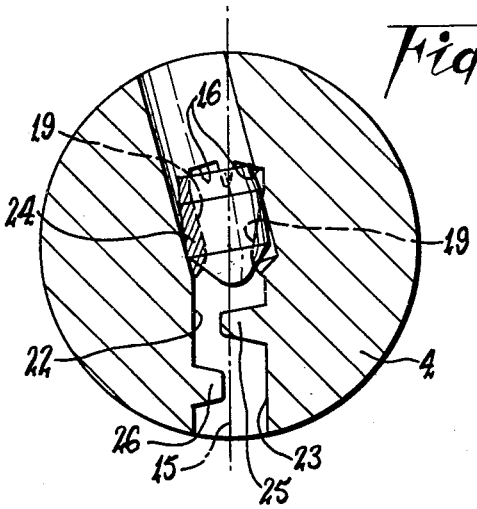
FIG. 4 is a view similar to FIG. 3.
Figure 5:
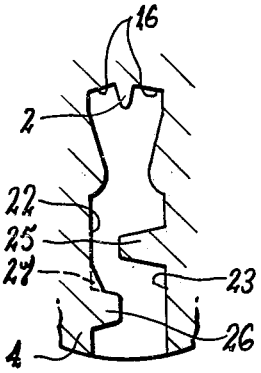
FIGS. 5 to 10 show various modifications to the basic profile of the keyway as shown in FIG. 4.
Figure 6:
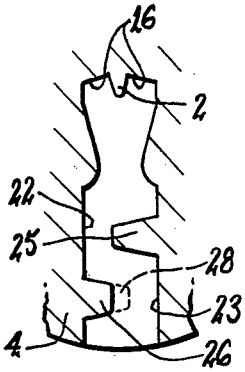
Figure 7:
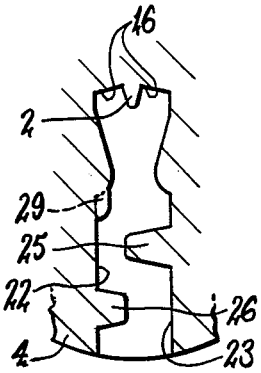
Figure 8:
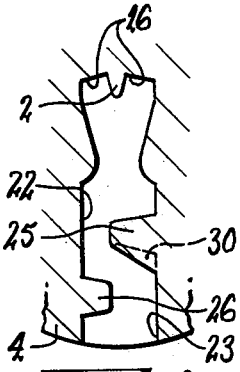
Figure 9:
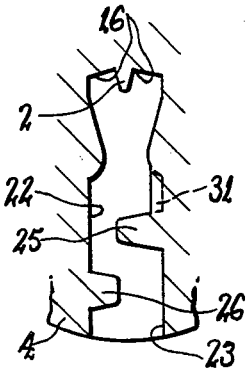
Figure 10:
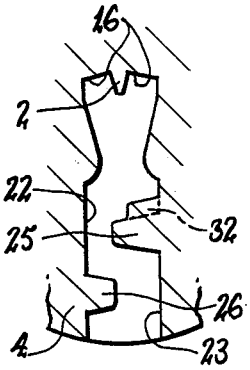

The keyway 3 can be profiled as desired below the neck 17 in a lower region of the keyway 3. That region may have a basic profile or paracentric shape formed by a pair of longitudinally extending rubs 25 and 26 each of which projects laterally into the keyway space from a respective opposite side of the keyway 3. The rib 25 extends across the median plane 15 of the keyway 3 whereas the other rib 26 terminates before the plane 15, but other relationships are possible. That basic profile can be varied in a great many ways to suit master keying and other systems. FIG. 4 shows one possible form of the basic profile and FIGS. 5 to 10 show a number of possible variations all derived from the basic profile so that a master key can be made to suit all of the different profiles shown. Any two or more of the variations shown by FIGS. 5 to 10 could be combined in a single keyway 3 and the same master key will of course be operative. It will be appreciated that the basic profile shown is an example only as there may be more than one paracentric rib on either or both sides of the keyway 3 and a rib could be completely omitted on one side. It will be seen that all profile modifications are effected by removing a section of metal 27 to 32 respectively at a place where the side surface of the keyway 3 changes direction and which is below the neck 17.

The lock construction described has the advantage of inhibiting improper manipulation as previously mentioned, but it also enables use of a large number of combinations because of the possible use of two series 5 of pins and the way in which the keyway 3 can be profiled. It is significant that those advantages are achievable with use of a lock body or cylinder 9 no larger than bodies or cylinders presently in use and having generally the same form. Furthermore, the overall width of the keyway 3 as used in the present invention need not be greater than that of previous lock keyways.

Figure 12:
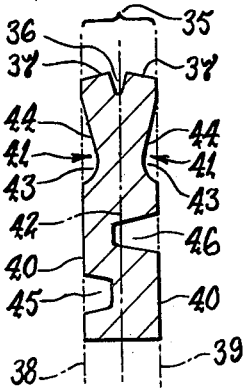
FIG. 12 is an enlarged transverse cross sectional view taken along line XII—XII of FIG. 11.

According to a further aspect of the invention, there is provided a key blank having a head 33 and an elongate blade 34 extending from one side of the head 33 (see FIGS. 11 and 12).

The upper edge surface 35 of the blade 34 has a longitudinally extending groove 36 formed therein. Furthermore, the blade width narrows in a region below the upper edge surface 35 and then widens again. The widening may be relatively abrupt and preferably occurs within the upper 50 percent of the blade 34.

In the preferred form shown, the blade 34 has a cross sectional shape complementary to that shown for the keyway 3 in FIG. 4. That is, the blade groove 36 accepts the keyway projection 2 and the narrowing of the blade 34 is substantially complementary to the waisted region of the keyway 3. It is also preferred that the two parts 37 of the blade upper edge surface 35 which are separated by the groove 36 each slopes downwardly away from the groove 36 so as to conform to the slope on the corresponding parts 16 of the keyway 3.

As seen more clearly in FIG. 12, the blade 34 has a maximum width defined between two parallel planes 38 and 39 and part of each side surface 40 lies within a respective one of those planes. The width of the upper part of the blade 34 is reduced by two waisting grooves 41 which are substantially symmetrical about the median plane 42 of the blade 34. In the preferred arrangement shown, each groove 41 progressively increases in depth downwards from adjacent the upper edge surface 35 to a region 43 of maximum depth which corresponds in location to the neck 17 of the keyway 3. The progressive increase in groove depth is along a sloping face 44 which is preferably normal to the adjacent surface part 37. It is further preferred that the blade width increases abruptly to maximum width belwo the region 43. Paracentric grooves 45 and 46 are provided in respective side surfaces 40 of the blade 34 to correspond with the paracentric ribs 26 and 25 of the keyway 3.

A blank as described has two pin engaging surfaces, which are the surface parts 37 separated by the groove 36. Either one of the features mentioned presents a difficulty for a person wishing to duplicate the key blank, and relatively simple machinery as now used for key cutting purposes would not be adequate. FIG. 13 shows a key cut from the blank described above. In particular, bittings are cut or otherwise formed in the upper edge surface of the blade 34 to suit a particular lock combination, and those bittings create alternating humps 47 and valleys 48. At least some of the humps 47 have their apex region separated by part of the groove 36 as best seen in FIG. 14. It is a characteristic of the key shown that the surface 49 at the base of each valley 48 slopes laterally, i.e., each surface 49 is at an angle other than a right angle relative to the median plane 42 of the blade 34. The extent of the slope can be determined to suit requirements and may not be the same for all bittings. Furthermore, the slope for any one or more of the bittings may be in a direction opposite to that employed for the other bittings or bitting.

In the preferred arrangement shown, the bittings are cut so that each alternate surface 49 slopes in the same direction and at the same angle and each two adjacent surfaces 49 slope in the opposite direction but at the same angle (see FIGS. 15 and 16). It is further preferred that each surface 49 is substantially parallel to one of the upper edge surface parts 37. In cutting such a key, a cutting wheel 50 (FIG. 15) is passed transversely across the upper edge surface 35 along a path 51 which is parallel to one of the surface parts 37. The slope of the path 51 however, reverses for each alternate bitting. This method—i.e. of using a sloping out—enables the use of a larger wheel 50 than would be otherwise possible.

Since there will be two series of pins engageable with the contoured (bittings) upper surface 35 of the key blade 34, the angular relationship between those series is preferably such that the barrel pins 10 do not lose contact with the bitted surface during movement of the key blade 34 into and out of the keyway 3. The lateral slope of the surfaces 49 also relates to this point since that increases penetration of the barrel pins 10 into the keyway 3 when the pins 10 engage with the lower side of a surface 49. FIG. 14 shows the contact path of each of two pins 10 of respective series 6 as the key blade 34 is moved past those pins. One pin 10 engages along contact path 52 whereas the other engages along contact path 53, and it will be seen that the paths 52 and 53 cross at each side of each base surface 49.

At least one of the humps 47 is sufficiently high to retain part of the groove 36 and pins 10 of different series 6 will track over that hump, on respective opposite sides of the groove 36 as shown in FIG. 14. As those pins 10 move deeper into the valley 48 however, their paths of contact will converge and may actually cross (as shown) if the valley 48 is deep enough. It is also preferred that a short section 54 of the blade 34 adjacent the key head 33 retains part of the groove 36 so as to prevent full penetration of any similar key not having a comparable grooved section (FIG. 14).

It will be appreciated that the lateral slope of the bitting surfaces 49 makes it extremely difficult to duplicate the key by any simple technique. Certainly, the difficulty is increased substantially if the copyiest only has access to an impression of the key. In any event, such a key could not be duplicated by machinery of the kind previously used for key cutting purposes.

The upper or waisted region of the key blade 34 could be modified by profiling to further extend the range of a keying system employing a key as described. Naturally, any such variation should be reflected in the keyway of a lock with which the key is to be used. Such a procedure would be suitable if the lock employs stepped barrel pins such that the narrowed or waisted region of the keyway is not necessary to provide added support for the barrel pins.

It is to be understood that, in one form of the invention, the bitting surfaces 49 need not slope as described above but may be normal to the median plane of the blade 34.

It will be appreciated from the foregoing that the present invention, according to each of its aspects, provides a significant advantage over the prior art. The lock as described is difficult to pick and achieves that advantage without undue complication and consequent expense. The key blank is unique and makes duplication difficult, and the key described is particularly difficult to duplicate without special machinery.

Finally, it is to be understood that various alterations, modifications and/or additions may be introduced into the constructions and arrangements of parts previously described without departing from the spirit or ambit of the invention as defined by the appended claims.

Having now described our invention, what we claim as new and desire to secure by Letters Patent is:

1. A key blank including:

an elongate blade having two oppositely-facing side surfaces, an upper-edge surface and a lower-edge surface, each of which extends between said side surfaces;

a dividing groove separating two laterally-spaced parts of said upper-edge surface and extending longitudinally inwards of said blade from an outer terminal end thereof;

a waisting groove in at least one of said side surfaces at a location adjacent to said upper-edge surface and extending longitudinally inwards of said blade from said outer terminal end, said waisting groove causing the width of said blade to reduce progressively away from a region adjacent said upper-edge surface to a region of minimum width which is located closer to said upper-edge surface than to said lower-edge surface; and a zone of maximum width of said blade located below and adjacent to said region of minimum width.

2. A key blank according to claim 1 having said waisting groove in each of said side surfaces.

3. A key blank according to claim 2, wherein said waisting grooves are substantially symmetrical and in directly opposed relationship.

4. A key blank according to claim 1, wherein the said waisting groove has a region of maximum depth located remote from said upper-edge surface and progressively reduces in depth from said region of maximum depth in a direction towards said upper-edge surface.

5. A key blank according to claim 1, wherein said dividing groove is located substantially midway in the width of said upper edge surface, and each said upper edge surface part slopes laterally outwards and downwardly towards the adjacent said side surface.

6. A key blank according to claim 5, wherein said progressive reduction in groove depth is along a sloping substantially-flat face of said waisting groove and the adjacent said upper-edge surface part is substantially normal to that sloping face.

7. A key blank according to claim 1, wherein said blade has a maximum width defined by the spacing between two substantially-parallel planes, each of said side surfaces has at least part thereof lying within a respective one of said planes and said waisting groove does not intrude into said upper-edge surface.

8. A key including:

an elongate blade having two oppositely-facing side surfaces, an upper-edge surface and lower-edge surface, each of which extends between said side surfaces;

a series of bittings in said upper-edge surface to provide a plurality of valleys and humps which alternate in the longitudinal direction of said blade;

a dividing groove extending in the longitudinal direction of said blade to the apex region of at least one of said humps and separating two laterally-spaced tumbler-engaging surface parts of that hump;

a waisting groove in at least one of said side surfaces at a location adjacent said upper-edge surface and extending longitudinally inwards of said blade from an outer terminal end thereof, said waisting groove causing the width of said blade to reduce progressively away from a region adjacent said upper-edge surface to a region of minimum width which is located closer to said upper-edge surface than to said lower-edge surface; and a zone of maximum width of said blade located below and adjacent to said region of minimum width.

9. A key according to claim 8, wherein said blade has a maximum width defined by spacing between two substantially parallel planes, and each of said side surfaces has a least part thereof lying within a respective one of said planes.

10. A key according to claim 8, wherein at least one paracentric groove is in each said side surface at a location between said waisting groove and said lower-edge surface, each said paracentric groove extending longitudinally inwards of said blade from said outer terminal end.

11. A key according to claim 8, wherein said waisting groove is in each said side surface, said waisting grooves being in symmetrical relationship, each said waisting groove having a region of maximum depth located remote from said upper-edge surface and progressively reducing in depth from said region of maximum depth in a direction towards said upper surface, and said progressive reduction in groove depth is along a substantially-flat sloping face of said waisting groove.

12. A key according to claim 11, wherein each said tumbler engaging surface part is arranged substantially normal to a respective said waisting groove sloping face.

13. A master-keyed system including a plurality of keys according to claim 10, at least two said keys being operable to open the same lock and each having the same paracentric shape as determined by the location, shape and depth of said paracentric grooves, at least one said key being profiled in the region of said paracentric shape, and said profiling comprising at least one modification to the cross sectional shape of said blade at a place where the surface of the blade changes direction.

14. A pin-tumbler lock including:

a cylinder;

a barrel rotatably mounted in said cylinder;

a keyway through a front end of said barrel and extending inwardly of the barrel in the longitudinal direction of the barrel rotational axis;

two series of pin tumblers mounted in said cylinder, each said series including a plurality of pin-tumbler groups arranged in spaced relationship in the direction of said rotational axis, the pins of each said group being movable towards and away from said barrel and a lower pin of each said group being adapted to intrude into said keyway, the pins of each said series being movable in a direction angularly disposed relative to the direction of movement of the other said series;

said keyway having an upper-edge surface located adjacent said tumbler pins, a projection dividing said upper-edge surface at least along part of its length, and a relatively narrow neck formed in said keyway at a location closer to said upper-edge surface than to a lower-edge surface of said keyway, said neck being formed by a rib provided on at least one of two opposite sides of said keyway, and a zone of maximum width of said keyway being located below and adjacent to said rib.

15. A pin tumbler lock according to claim 14, wherein the pin-tumbler groups of each said series are spaced from said barrel front end a distance different to the corresponding spacing of the pin-tumbler groups of the other said series.

16. A pin-tumbler lock according to claim 14 wherein said projection is a rib extending substantially the full length of said keyway.

17. A pin-tumbler lock according to claim 16, wherein the part of said upper-edge surface on each side of said rib is arranged substantially normal to the said direction of movement of the pins of a respective said series.

18. A combination including a lock according to claim 14 and a key having an elongate blade receiveable in said lock keyway, said blade having a series of bittings formed in an upper-edge surface thereof to provide a plurality of valleys and humps which alternate in the longitudinal direction of said blade, the apex region of at least one said hump being divided by a longitudinally-extending groove to permit passage of said blade past said keyway projection, a separate pin-engaging surface part on each side of said groove and each said surface part is engageable with at least one said lower pin of a respective said tumber-pin series.

19. A method of forming a key including the steps of, forming a key blank having a head and elongate blade extending from one side of said head, said blade being substantially flat and parallel sided, forming a dividing groove in one edge surface of said blade to separate two laterally-spaced edge surface parts, forming a longitudinal-extending waisting groove in each of two side surfaces of said blade adjacent to said divided edge surface, said two waisting grooves being arranged substantially symmetrical about a median plane (as herein defined) of said blade, forming at least one longitudinally-extending paracentric groove in each said side surface at a location between the adjacent said waisting groove and an edge surface of said blade remote from said divided edge surface, forming a series of bittings in said divided edge surface to create alternating humps and valleys, each said valley being formed by passing a cutting tool transversely across said divided edge surface and in a direction extending at an angle other than 90° relative to said median plane, the said relative angularity being the same for each alternate valley and being opposite for each two adjacent valleys.

20. A method according to claim 19, wherein the cross-sectional shape of said blade is modified by removing a longitudinal section of said blade in the paracentric region thereof and at a place where the side surface of said blade changes direction.

21. A key blank including:

an elongate blade having two oppositely-faced side surfaces, an upper-edge surface and a lower-edge surface, each of which extends between said side surfaces;

a dividing groove separating two laterally-spaced parts of said upper-edge surface and extending longitudinally inwards of said blade from an outer terminal end thereof;

a waisting groove in at least one of said side surfaces at a location adjacent said upper-edge surface and extending longitudinally inwards of said blade from said outer terminal end;

said dividing groove being located substantially midway in the width of said upper-edge surface, and each said upper-edge surface part sloping laterally outwardly and downwardly towards the adjacent said side surface.

22. A key including:

an elongate blade having two oppositely-facing side surfaces, an upper-edge surface and a lower-edge surface, each of which extends between said side surfaces;

a series of bittings in said upper-edge surface to provide a plurality of valleys and humps which alternate in the longitudinal direction of said blade, the surface at the base of each said valley being angularly disposed to the median plane (as herein defined) of the blade, and at least two of said blade surfaces being arranged angularly relative to one another;

a dividing groove extending in the longitudinal direction of said blade through the apex region of at least one of said humps and separating two laterally-spaced tumbler-engaging surface parts of that hump; and a waisting groove in each of said side surfaces at a location adjacent said upper-edge surface and extending longitudinally inwards of said blade from an outer terminal end thereof; the waisting grooves being in symmetrical relationship, each having a region of maximum depth located remote from said upper-edge surface and progressively reducing in depth from said region of maximum depth in a direction towards said upper surface; said progressive reduction in groove depth being along a substantially-flat sloping face of said waisting groove.

23. A key according to claim 22, wherein each said base surface is substantially normal to either one of said waisting-groove sloping faces.

24. A key including:

an elongate blade having two oppositely-facing side surfaces, an upper-edge surface and a lower-edge surface, each of which extends between said side surfaces;

a series of bittings in said upper-edge surface to provide a plurality of valleys and humps which alternate in the longitudinal direction of said blade;

a dividing groove extending in the longitudinal direction of said blade through the apex region of at least one of said humps and separating two laterally-spaced tumbler-engaging surface parts of that hump; and a waisting groove in at least one of said side surfaces at a location adjacent said upper-edge surface and extending longitudinally inwards of said blade from an outer terminal end thereof; the waisting groove causing the width of said blade to reduce progressively away from said upper-edge surface to a region of minimum width which is located closer to said upper-edge surface than to said lower-edge surface; a zone of maximum width of said blade being located below and adjacent to said region of minimum width.

25. A key according to claim 24, wherein at least one paracentric groove is in each said side surface at a location between said waisting groove and said lower-edge surface, each said paracentric groove extending longitudinally inwards of said blade from said outer terminal end.

26. A pin-tumbler lock including:

a cylinder;

a barrel rotatably mounted in said cylinder;

a keyway through a front end of said barrel and extending inwardly of the barrel in the longitudinal direction of the barrel rotational axis;

two series of pin tumblers mounted in said cylinder, each said series including a plurality of pin-tumbler groups arranged in spaced relationship in the direction of said rotational axis, the pins of each said group being movable towards and away from said barrel and a lower pin of each said group being adapted to intrude into said keyway, the pins of each said series being movable in a direction angularly disposed relative to the direction of movement of the other said series;

said keyway having an upper-edge surface located adjacent said tumbler pins, a projection dividing said upper-edge surface at least along part of its length, and a relatively narrow neck formed in said keyway at a location closer to said upper-neck surface than to a lower-edge surface of said keyway; said neck being formed between two ribs, each of which is provided on a respective opposite side of said keyway and extends in the longitudinal direction of the keyway, each said neck rib having a substantially flat face which slopes upwardly towards said upper-edge surface and away from the opposite side of the said keyway, and the two said neck ribs being substantially symmetrical about the median plane (as herein defined) of said keyway.

27. A pin-tumbler lock according to claim 26, wherein said keyway has at least one paracentric rib projecting inwards from each side thereof and extending in the longitudinal direction of the keyway, each said paracentric rib being located below said neck ribs, and said keyway has a paracentric shape determined by the location, shape and depth of said paracentric ribs.

28. A pin-tumbler lock according to claim 27, wherein said keyway is profiled in the region of said paracentric shape, said profile comprising at least one modification to the cross-sectional shape of said keyway at a place where a side surface of said keyway changes direction.

29. A lock system including a plurality of locks according to claim 28 and at least one key, the keyway of each said lock having the same paracentric shape but being profiled differently to the other said locks, and said key having a blade with a transverse cross-sectional shape which is receiveable in each said keyway.

30. A combination of a lock and a key wherein the lock is a pin-tumbler lock including:

a cylinder;

a barrel rotatably mounted in said cylinder;

a keyway through a front end of said barrel and extending inwardly of the barrel in the longitudinal direction of the barrel rotational axis;

two series of pin tumblers mounted in said cylinder, each said series including a plurality of pin-tumbler groups arranged in spaced relationship in the direction of said rotational axis, the pins of each said group being movable towards and away from said barrel and a lower pin of each said group being adapted to intrude into said keyway, the pins of each said series being movable in a direction angularly disposed relative to the direction of movement of the other said series;

said keyway having an upper-edge surface located adjacent said tumbler pins, a projection dividing said upper-edge surface at least along part of its length, and a relatively narrow neck formed in said keyway at a location closer to said upper-edge surface than to a lower-edge surface of said keyway;

and wherein the key has an elongate blade receivable in said lock keyway, said blade having:

a series of bittings in an upper-edge surface thereof to provide a plurality of valleys and humps which alternate in the longitudinal direction of said blade, the apex region of at least one said hump being divided by a longitudinally-extending groove to permit passage of said blade past said keyway projection; and a separate pin-engaging surface part on each side of said groove, each said surface part being engageable with at least one said lower pin of a respective said tumbler pin series, each said lower pin maintaining engagement with the bitted surface of said key blade so long as said bitted surface is located below the respective said lower pin and, during movement of said key blade into and out of said keyway, at least one of said lower pins of one said series engages said bitted surface along a path which crosses the path of engagement of a said lower pin of the other said series with that bitted surface.

31. A combination according to claim 30, wherein said paths cross on each side of at least one said valley.

* * * * *